United States Patent [19]

Miyazaki et al.

[11] 4,060,207

[45] Nov. 29, 1977

[54] YARN WINDING MECHANISM IN SPINNING MACHINE

[75] Inventors: Tsutomu Miyazaki, Kariya; Yoshiaki Yoshida, Ohbu; Shozo Ueda, Kariya; Kinpei Mitsuya, Aichi; Takeshi Ogasawara, Gamagori, all of Japan

[73] Assignee: Kabushiki Kaisha Toyoda Jidoshokki Seisakusho, Kariya, Japan

[21] Appl. No.: 766,507

[22] Filed: Feb. 7, 1977

[30] Foreign Application Priority Data

Feb. 10, 1976 Japan ..... 51-12806

[51] Int. Cl.[2] ..... B65H 54/02

[52] U.S. Cl. ..... 242/18 R; 57/34 R; 242/18 DD; 242/18 PW; 242/45

[58] Field of Search ..... 242/18 R, 18 DD, 18 PW, 242/18 A, 35.5 R, 35.5 A, 45, 47, 153, 154, 147 R, 43 R, 43 A; 57/34 R

[56] References Cited

U.S. PATENT DOCUMENTS

| | | | |
|---|---|---|---|
| 3,921,921 | 11/1975 | Katayama et al. | 242/18 DD |
| 3,923,260 | 12/1975 | Sakurai et al. | 242/18 A |
| 3,974,972 | 8/1976 | Egli et al. | 242/18 PW |
| 4,002,305 | 1/1977 | Takeuchi et al. | 242/18 PW |

FOREIGN PATENT DOCUMENTS

| | | | |
|---|---|---|---|
| 217,659 | 6/1924 | United Kingdom | 242/45 |
| 434,747 | 9/1935 | United Kingdom | 242/18 DD |

*Primary Examiner*—Stanley N. Gilreath
*Attorney, Agent, or Firm*—Wenderoth, Lind & Ponack

[57] ABSTRACT

A yarn winding mechanism includes a reference point through which the yarn always passes during yarn piecing-up and normal winding operations, a pair of yarn taking-out rollers disposed above the reference point, and a traversing device from which the yarn is wound onto a cone cheese. In order to cause the winding mechanism to soon begin and then continue the normal winding operation after completion of the yarn piecing-up, a device for compensating changes in yarn tension is disposed between the traversing device and the yarn taking-out rollers with a yarn guide surface extending generally parallel to the axis of the taking-out roller, and the upper taking-out roller is formed with a yarn catch in one end face edge thereof on the larger diameter side of the cone cheese, the yarn catch being arranged in an optimum position with respect to the parallelly extending surface of the tension compensating device and the reference point.

4 Claims, 6 Drawing Figures

YARN WINDING MECHANISM IN SPINNING MACHINE

BACKGROUND OF THE INVENTION

This invention relates to a yarn winding mechanism in a spinning unit of a spinning machine, which is provided with a device for compensating changes in yarn tension due to cone winding by the winding mechanism.

In the yarn winding mechanism, generally, the yarn is traversely wound onto a suitable bobbin to obtain a desirable cone cheese, and therefore the winding mechanism must be provided with a device for compensation for changes in yarn tension caused by both the cone winding and the traverse. Furthermore, in the case of an open end spinning unit wherein a yarn is positively discharged out of a spinning chamber, a yarn number is apt to be affected by a speed at which the yarn is taken out of the spinning chamber. Therefore, when it is desired to produce a uniform number of yarn, the yarn taking-out speed should be maintained constant, otherwise a poor quality of yarn will be produced. To ensure the yarn being traversely wound at the constant speed, each open end spinning unit in the open end spinning machine has a pair of yarn taking-out rollers disposed between the winding bobbin and the yarn discharge tube. The yarn taking-out rollers firmly hold the yarn therebetween and take it out of the yarn discharge tube at the constant speed.

In such a spinning unit, on occurrence of a yarn breakage during the spinning operation, a yarn breakage detecting device detects the yarn breakage and provides a signal to stop a supply of fibers into the open end spinning chamber. A cut end of yarn is wound up onto the cone cheese. When it is desired to carry out the yarn ending, the cone cheese is relieved from a drive roll and thereafter the yarn cut end is wound off until it is led to the outlet of the yarn discharge tube without passing between the yarn taking-out rollers, whereupon the cut end is sucked into the rotary spinning chamber and reaches on a fiber collecting surface thereof, where it is connected with the fibers supplied again into the spinning chamber. In order that the yarn is taken out of the spinning chamber at the constant speed, the yarn must be placed between the yarn taking-out rollers without error immediately after completion of the yarn ending. However, this requirement has not been satisfied with the prior art winding mechanisms.

It is accordingly a primary object of this invention to provide a yarn winding mechanism in a spinning unit which is capable of placing a yarn between a pair of yarn taking-out rollers with no error immediately after completion of yarn ending.

SUMMARY OF THE INVENTION

With this object in view, the invention resides in a yarn winding mechanism in a spinning unit comprising a pair of yarn taking-out rollers taking the yarn out of a yarn discharge point of the spinning unit, a traversing device for traversing the yarn discharged from the yarn discharge point, and a cone bobbin onto which the yarn is traversely wound in a cone cheese, one of the yarn taking-out rollers being provided with a yarn catch in its end face edge, characterized in that a yarn tension compensating device is disposed between the traversing device and the yarn taking-out rollers with a yarn guide surface so contoured as to compensate changes in yarn tension due to the traverse and cone winding of the yarn, a portion of the yarn guide surface of the compensating device on the larger diameter side of the cone bobbin being so shaped and positioned that the yarn following a path adjacent to one of endmost paths between which the yarn traverses on the yarn discharge point is caused to be caught by the yarn catch of the yarn taking-out rollers on the larger diameter side of the cone bobbin. According to the invention, the yarn tension compensating device essential to the yarn winding mechanism with the traversing device is utilized, without injuring its fundamental function, to force the yarn between the yarn taking-out rollers immediately after completion of the yarn ending. Therefore, the yarn winding mechanism of the invention can fulfil, in spite of its simple construction, all the following requirements for operation of an open end spinning machine:

1. After completion of a yarn ending, a yarn is caused to be automatically brought between paired yarn taking-out rollers with no error;
2. Immediately after completion of the yarn ending, the yarn is forced to follow a normal traverse path; and
3. The yarn uniform in thickness is to be produced to coincide with an intention of the open end spinning machine.

BRIEF DESCRIPTION OF THE DRAWINGS

For better understanding of the invention, reference may be had to the preferred embodiments, exemplary of the invention, shown in the accompanying drawings, in which.

DESCRIPTION OF THE PREFERRED EMBODIMENTS

Figure 1:
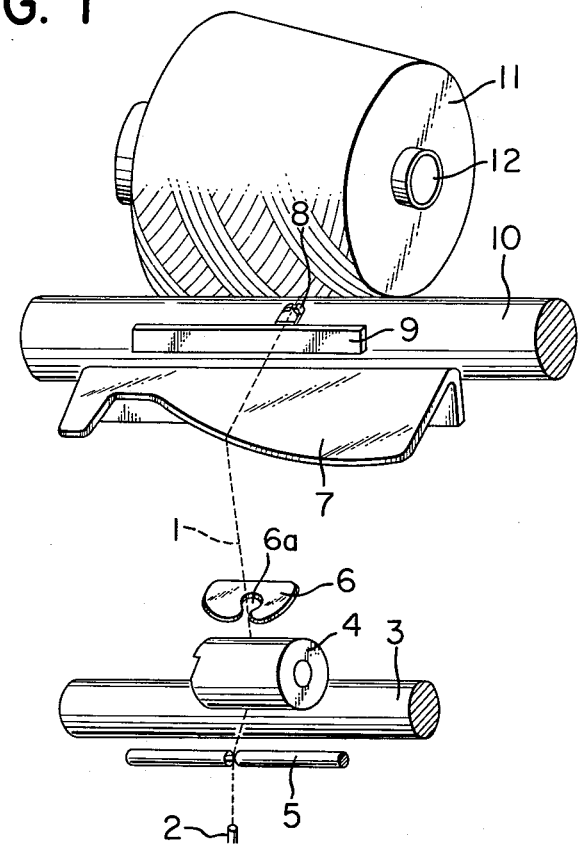
FIG. 1 is a perspective view of a partial yarn winding mechanism incorporating the invention.

Referring now to the drawings and more particularly to FIG. 1, there is shown a yarn winding mechanism according to the invention, which mechanism is provided for each of spinning units of an open end spinning machine. It is therefore stated that the following descriptions, made in conjunction with the single yarn windings mechanism, are also applicable to other yarn winding mechanisms.

In FIG. 1, positioned above a yarn taking-out point or tube 2, through which a spun yarn 1 shown by dotted line is taken out of a not shown spinning chamber of the spinning unit, are a lower yarn guide 5 in the form of an elongated generally cylindrical bar common to the other spinning units, a lower yarn taking-out roller 3 extending along about the overall length of the spinning machine and adapted to be rotated by a not shown driving means, and an upper yarn taking-out section roller 4 forming a yarn holding nip in cooperation with the lower yarn taking-out roller 3. Immediately above the section roller 4 is an upper yarn guide 6 consisting of a generally D-shaped plate with an eyelet 6*a*. A device for compensating a differential yarn tension during a winding operation is disposed above the upper yarn guide 6. The compensation means comprises a plate member 7 of a generally L-cross section, which will be hereinafter described in detail. Above the plate member 7 is arranged a traversing device 9 composed by a plate or bar member, which is provided with a yarn guiding portion 8 shaped to form an open loop and traversed by a well known driving means (not shown). On the downstream of the traversing device 9 with respect to the travel of the yarn 1 is disposed a drive roll 10, which extends along the overall length of the open-end spinning machine and has a cone cheese 11 disposed thereon in frictional driving engagement therewith, the cone cheese 11 carrying a suitable bobbin or carrier 12 for receiving the traversely wound yarn.

Figure 2:
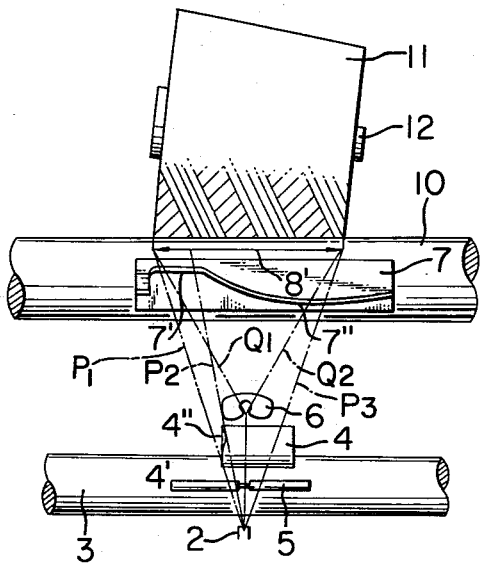
FIG. 2 is a front elevational view of FIG. 1, showing paths through which a yarn travels.
Figure 3:
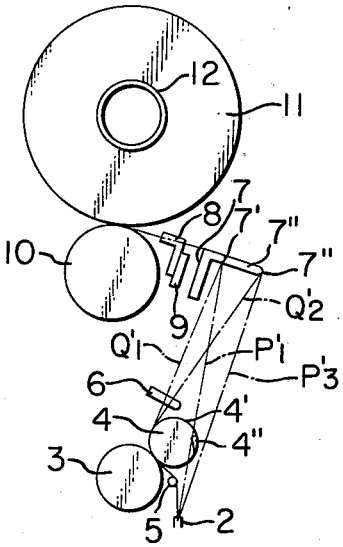
FIG. 3 is a view from the left side of the winding mechanism shown in FIG. 2.

In normal operation of the open end spinning machine, as shown in FIG. 1, the yarn 1, after passing through the tube 2, is led through a circumferential channel provided in the lower guide 5 and between the lower and upper yarn taking-out rollers 3 and 4, by which the yarn 1 is taken out of the tube 2 at a predetermined speed. Then, the yarn 1 is led through the eyelet 6a of the upper guide 6, over the tension compensating device 7 and to the traversing device 9 from which it is taken-up onto the cone cheese 11. On the one hand, the yarn 1 traverses, in FIG. 2, between leftmost and rightmost paths $Q_1$ and $Q_2$ with a maximum width 8' of traverse, and on the other hand, in FIG. 3, it makes swinging motion between paths $Q'_1$ and $Q'_2$. In FIG. 3, the paths $Q_1$ and $Q_2$ (FIG. 2) are represented by the paths $Q'_1$ and $Q'_2$, respectively. Thus, it is understood that the yarn 1 is caused to vary in tension due to a difference in diameter between the ends of the cone cheese 11 and due to a change in path length from the upper guide 6 to a surface of the cone cheese 11 on which the traversed yarn is being wound. The compensating device 7 has guide surfaces 7' and 7'' providing a particular contour, as described hereinafter, in order to compensate any difference in tension of the yarn, which otherwise would occur during the cone winding.

When it is desired to carry out yarn ending, the cone cheese 11 is moved up to separate from the drive roll 10 and the yarn 1 wound up on the cone cheese 11 is unwound to allow the leading end of the unwound yarn to be led closely adjacent to the outlet of the yarn discharge tube 2, whereupon the leading end is sucked into the rotary spinning chamber (not shown) and reaches onto a fiber collecting surface thereof, where the leading end is entangled with fibers supplied again into the spinning chamber. Substantially simultaneously with the entanglement, the cone cheese 11 is brought again into driving engagement with the drive roll 10 to wind the yarn thereonto, thus completing the yarn ending. At this time, when looking in FIG. 2, the pieced-up yarn is in a certain path present between the paths $P_1$ and $P_3$. However, since the traversing device 9 is adapted to continue traversing even during the piecing-up operation, the tension of the yarn increases immediately on completion of the piecing-up and therefore the yarn is caught in the yarn guiding portion 8 of the traversing device 9. This causes the yarn to be forced to follow the path $P_1$ (or $P'_1$ when looking in FIG. 3) in a short time because of the traverse of the traversing device 9. Then, the yarn is traversed toward the path $P_3$, shown in FIG. 2, corresponding to the path $P'_3$ in FIG. 3.

In the meantime, the yarn has to be nipped between the taking-out rollers 3 and 4 quickly and surely so that it takes the normal course of traverse between the paths $Q_1$ and $Q_2$ as soon as possible. The yarn also has to be traversely wound onto the bobbin 12 at constant speed and with constant tension.

To meet these requirements, according to the invention, the upper yarn taking-out roller 4 is arranged in improved relation with respect to the aforesaid path of the yarn, where the yarn runs before it takes the normal course of travel, and the compensating device 7 has the special guide surfaces 7' and 7''. The upper taking-out roller 4 is provided, in its circumferential edge on the side of the larger diameter part of the cone cheese 12, with at least one notch 4'' acting as a yarn catch, and the upper roller 4 has the yarn catch 4'' positioned adjacent the endmost yarn path $P_1$ from the yarn discharge tube 2 directly over the yarn guide 7 to the cone cheese 11 so that when it rotates the yarn catch 4'' interfaces with the yarn traversing near the endmost yarn path $P_1$. Of the guide surfaces 7' and 7'' of the yarn guide 7, the linearly extending guide surface 7' is on the larger diameter side of the cone cheese 11 and therefore, with reference to the yarn under the transition condition to the normally wound condition, the yarn present between the path $P_1$ and a path adjacent the path $P_2$ where it is caught by the catch 4'' is guided by the surface 7'. The surface 7' is generally parallel to the axis of the upper taking-out roller 4. In other words, the circular edge 4' of the upper taking-out roller 4 is positioned between the paths $P_1$ and $P_2$ in FIG. 2 when looking from the front of the upper taking-out roller 4 and to intersect with the path $P'_1$ in FIG. 3 when looking from the left side of the upper taking-out roller 4. Since the guide surface 7' is substantially parallel to the axis of the upper taking-out roller 4, the yarn guided by the surface 7' traverses from the path $P_1$ toward the path $P_2$ when looking in FIG. 2. However, when looking in FIG. 3, the yarn guided by the surface 7' is moved toward the notched end of the upper taking-out roller 4 perpendicularly thereto. This ensures the yarn being caught by the yarn catch 4'' and brought into the nip between the lower and upper rollers 3 and 4.

Figure 4:
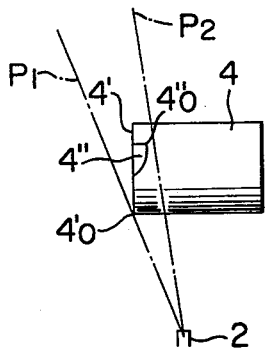
FIG. 4 is an enlarged front elevational view of one of paired yarn taking-out rollers employed in the winding mechanism of FIG. 2, showing positional relationships between the yarn taking-out roller and the yarn paths.
Figure 5:
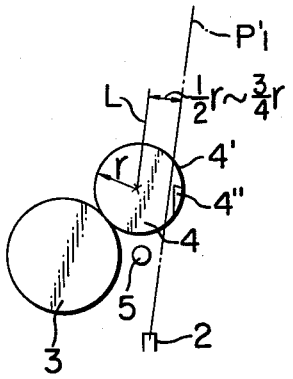
FIG. 5 is an enlarged side elevational view of the yarn taking-out rollers.

An additional detail is hereinafter described in conjunction with FIGS. 4 and 5. The position of the upper taking-out roller 4 and the length of the guide surface 7' are so selected, as shown in FIG. 4, that the path $P_1$ is located on the left side of a line connecting the yarn discharge tube 2 and a lowermost point $4'_0$ of the edge 4' and the path $P_2$ is locatd on the right side of a line connecting the yarn discharge tube 2 and an innermost portion $4''_0$ of the yarn catch 4'', provided that the yarn catch 4'' is in a position where it can interface with the yarn traversing from the path $P_1$ to $P_2$. With respect to FIG. 5, it can be stated that the path $P'_1$ corresponding to the path $P_1$ in FIGS. 2 and 4 is desirably so selected that a distance between the path $P'_1$ and a line L passing through the center of the roller 4 end face equals $(\frac{1}{2} \sim \frac{3}{4})r$, where $r$ represents the radius of the roller 4.

Figure 6:
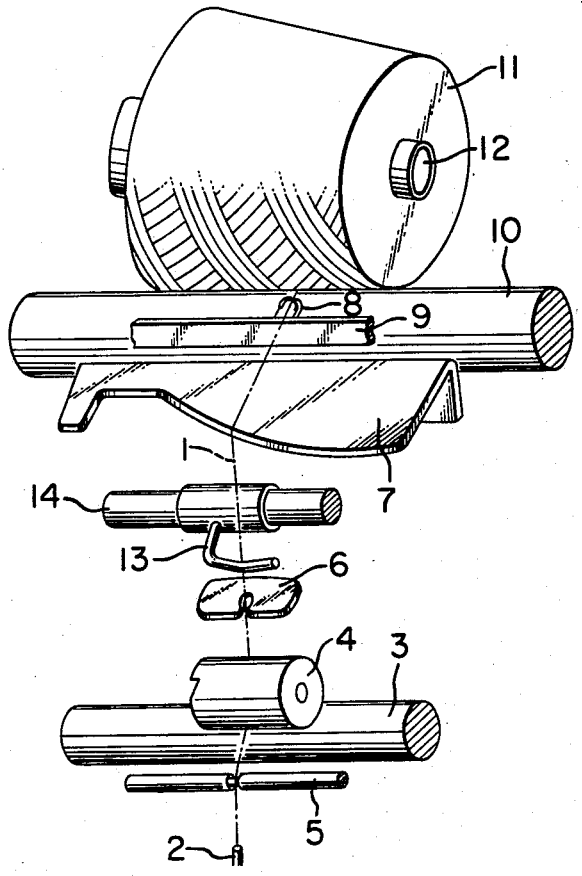
FIG. 6 is a perspective view corresponding to that of FIG. 1, showing another modification of the invention.

An embodiment shown in FIG. 6 is similar to that shown in FIGS. 1 – 5 except that it employs an additional movable yarn guide 13 loosely fitted onto a generally cylindrical support 14. The guide 13 is movable on the support 14 so as to compensate the change in tension of the yarn during the normal winding operation. During the piecing-up operation, the guide 13 can be brought out of the range of the traversing yarn and therefore the descriptions made in conjunction with FIGS. 2 – 5 are similarly applicable to the embodiment of FIG. 6.

In these embodiments, the compensating device 7 has been illustrated as each being formed by a separate plate member, although all or some of the yarn guides for the associated spinning units are formed in one piece. Additionally, the compensating device 7 may consist of a curved wire of suitable material, such as metal, or plastics. Although the descriptions have been made only in conjunction with a yarn winding mechanism in an open end spinning unit, the invention is not limited thereto.

What we claim is:

1. A yarn winding mechanism in a spinning unit comprising a pair of yarn taking-out rollers taking the yarn out of a yarn discharge point of the spinning unit, a traversing device for traversing the yarn discharged from the yarn discharge point, and a cone bobbin onto which the yarn is traversely wound in a cone cheese, one of the yarn taking-out rollers being provided with a yarn catch in its end face edge, characterized in that a yarn tension compensating device is disposed between the traversing device and the yarn taking-out rollers with a yarn guide surface so contoured as to compensate changes in yarn tension due to the traverse and cone winding of the yarn, a portion of the yarn guide surface of the compensating device on the larger diameter side of the cone bobbin being so shaped and positioned that the yarn following a path adjacent to one of endmost paths between which the yarn traverses on the yarn discharge point is caused to be caught by the yarn catch of the yarn taking-out roller on the larger diameter side of the cone bobbin.

2. The yarn winding mechanism as claimed in claim 1, characterized in that the portion of the yarn guide surface of the compensating device extends substantially parallelly to the axis of the yarn taking-out roller.

3. The yarn winding mechanism as claimed in claim 2, characterized in that the portion of the yarn guide surface of the compensating device has a sufficient length to cause the yarn, which is led from the yarn discharge point directly over the compensating device to the traversing device, to be caught by the yarn catch during it being traversed along the length thereof.

4. The yarn winding mechanism as claimed in claim 1, characterized in that, between the compensating device and the yarn taking-out rollers, a movable compensating device is provided comprising a support, and an arm loosely mounted on the support to engage the yarn, which is traversely wound onto the cone bobbin through a normal winding path.

* * * * *